US006837728B2

(12) United States Patent
Miyazaki et al.

(10) Patent No.: US 6,837,728 B2
(45) Date of Patent: Jan. 4, 2005

(54) EQUIPMENT-MOUNTING WIRE HARNESS

(75) Inventors: Sho Miyazaki, Aichi (JP); Hiroshi Aihara, Aichi (JP); Hiroyuki Tsukashima, Aichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/327,969

(22) Filed: Dec. 26, 2002

(65) Prior Publication Data

US 2003/0119351 A1 Jun. 26, 2003

(30) Foreign Application Priority Data

Dec. 26, 2001 (JP) ..... 2001-394946

(51) Int. Cl.[7] ..... H01R 13/52
(52) U.S. Cl. ..... 439/271; 439/559
(58) Field of Search ..... 439/271, 272, 439/273, 559, 560, 556, 557, 277, 281, 589, 587, 95, 564, 610, 607, 101; 174/36, 72 A, 102 R, 88 C, 154 C

(56) References Cited

U.S. PATENT DOCUMENTS 4,684,190 A * 8/1987 Clark et al. ..... 439/587
5,308,264 A * 5/1994 Perretta et al. ..... 439/607
6,053,749 A 4/2000 Masuda et al.
6,257,931 B1 * 7/2001 Sakurai et al. ..... 439/610

FOREIGN PATENT DOCUMENTS

JP A 11-26093 1/1999

* cited by examiner

*Primary Examiner*—Alexander Gilman
(74) *Attorney, Agent, or Firm*—Oliff & Berridge, PLC

(57) ABSTRACT

An equipment-mounting wire harness for mounting on equipment, which includes a shield casing for accommodating a plurality of equipment-side terminals. The equipment-mounting wire harness includes a plurality of wires and metal terminals. Each of the metal terminals includes a terminal connection portion for connecting to the equipment-side terminal and a wire connection portion for connecting to the wire. The wire harness further includes a connector body, a seal ring, a tubular shield member, a tubular shield member and a shield shell. The connector body can be fitted into the mounting hole and is molded to embrace the wire connection portions. The seal ring seals a gap between the connector body and an inner surface of a mounting hole of the shield casing. The tubular shield member collectively covers the wires in a surrounding manner. The shield shell secures an end portion of the shield member to the shield casing.

3 Claims, 5 Drawing Sheets

EQUIPMENT-MOUNTING WIRE HARNESS

BACKGROUND OF THE INVENTION

1. Field of the Invention

This invention relates to a wire harness for mounting on an equipment.

2. Background Art

JP-A-11-26093 discloses a conventional structure for connecting a plurality of shielded wires to an equipment such as an inverter device in an electric car. In this structure, mounting holes are formed in an electrically-conductive shield casing, and equipment-side terminals, provided within the shield casing, are disposed immediately adjacent respectively to these mounting holes in opposed relation thereto, and wire-side terminals, fixedly secured respectively to end portions of the shielded wires, are set respectively in the mounting holes, and are connected respectively to the equipment-side terminals, and an end portion of a shield layer of each of the shielded wires is connected to the shield casing. Generally, a tubular member (called a braided wire), which is so flexible as to be deformed, is used as a shield layer of a shielded wire, and the above conventional structure is not an exception. Therefore, in this conventional example, as means for surely connecting the easily-deformable shield layer to the shield casing, there is used a structure in which a shield shell of high rigidity is fitted on the shielded wire, and the shield layer is connected to the shield shell, and the shield shell is contacted with the shield casing.

Thus, in the conventional structure, although there are used the plurality of shielded wires, the separate shield shells are required respectively for the shielded wires, and therefore there has been encountered a disadvantage that the number of the shield shells, as well as the time and labor required for mounting the shield shells, increases.

And besides, in the above conventional example, as means for contacting the shield shell with the shield casing, there is used a structure in which the shield shell is mounted on a housing, and this housing is fitted in the mounting hole. The end portion of the shielded wire, to which the metal terminal is connected, is disposed forwardly of the shield shell, and therefore the end portion of the shielded wire projects from the housing. Therefore, there is a fear that a liquid (for example, lubricating oil) within the shield casing leaks to the exterior of the shield casing through gaps between metal wire elements forming the shielded wire.

SUMMARY OF THE INVENTION

This invention has been made under the above circumstances, and an object of the invention is to reduce the number of component parts and also to secure a sealing ability.

The invention provides an equipment-mounting wire harness for mounting on an equipment, wherein the equipment includes a shield casing accommodating a plurality of equipment-side terminals therein, the shield casing including a mounting hole which corresponds to the equipment-side terminals. The equipment-mounting wire harness includes: a plurality of wires; a plurality of metal terminals each including a terminal connection portion for connecting to the corresponding equipment-side terminal, and a wire connection portion for connecting to an end portion of the corresponding wire; a connector body capable of being fitted into the mounting hole, the connector body molded to embrace the wire connection portions; a seal ring for sealing a gap between the connector body and an inner surface of the mounting hole; a tubular shield member for collectively covering the plurality of wires in a surrounding manner; and a shield shell for securing an end portion of the shield member to the shield casing.

The connector body may include a plurality of the connector bodies, each separately molded to embrace the plurality of the metal terminals respectively; and the shield shell is capable of being moved along the wires while deforming the shield member.

DETAILED DESCRIPTION OF THE PREFERRED EMBODIMENTS

[First Embodiment]

Figure 1:
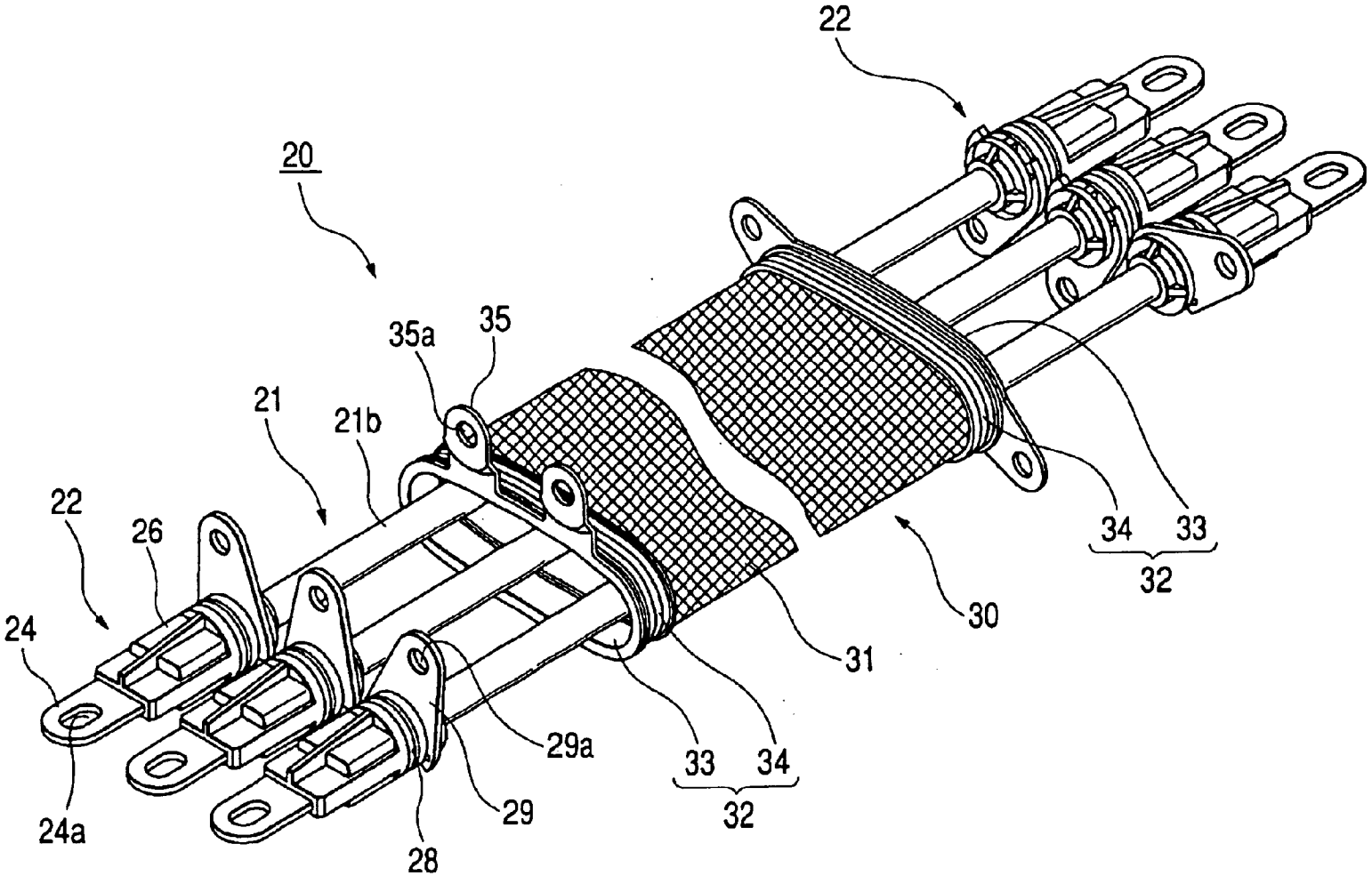
FIG. 1 is a perspective view of a first embodiment.
Figure 2:
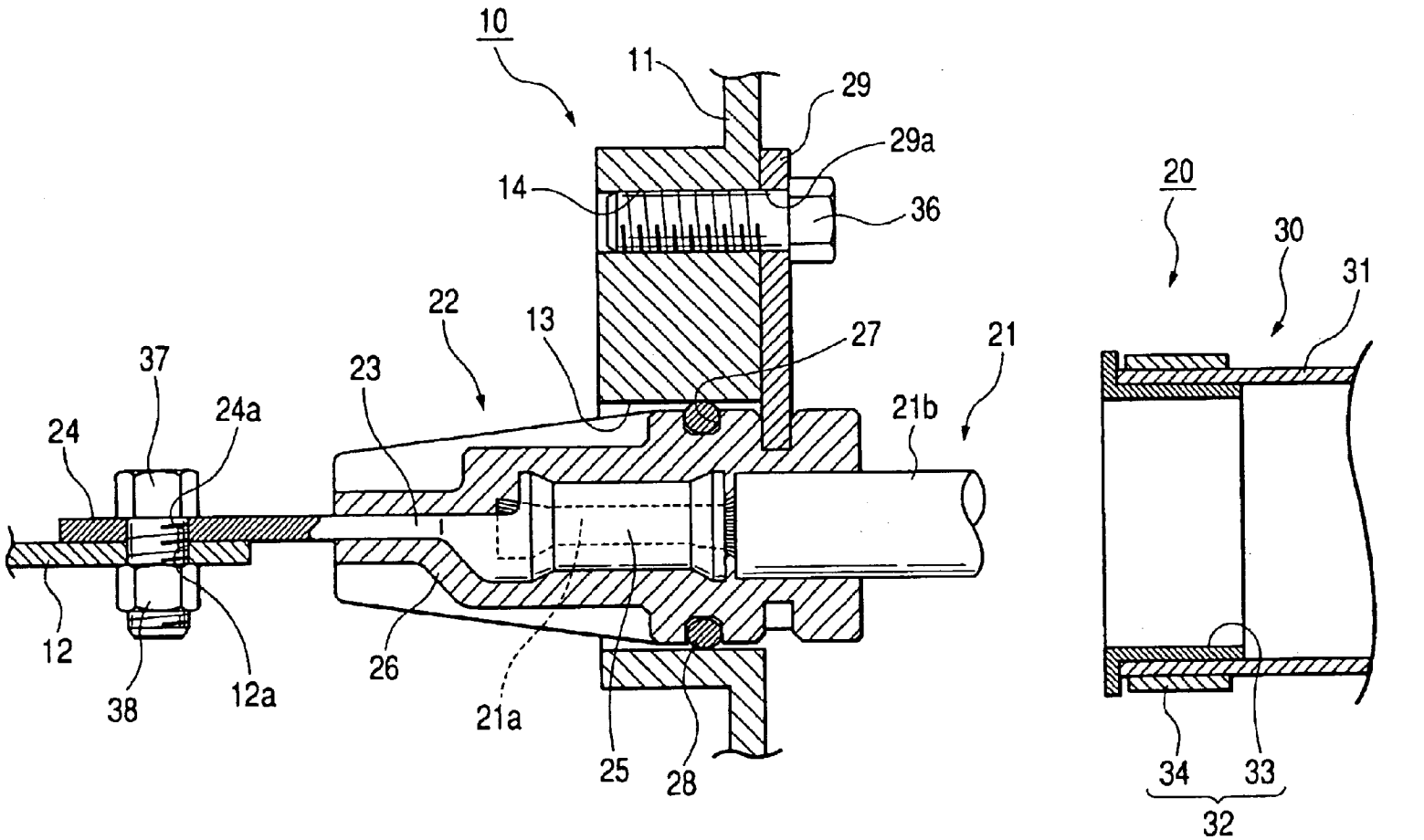
FIG. 2 is a cross-sectional view showing a condition in which a metal terminal and a connector body are mounted on an equipment.

A first embodiment of the present invention will now be described with reference to FIGS. 1 to 4.

First, an equipment 10, to which an equipment-mounting wire harness 20 (herein after referred to merely as "wire harness 20") of this embodiment is to be connected, will be described. The equipment 10 includes a shield casing 11 within which a plurality of equipment-side terminals 12 are received, and a plurality of mounting holes 13 of a round shape, corresponding respectively to the equipment-side terminals 12, are formed in the shield casing 11. Internal thread holes 14, corresponding respectively to the mounting holes 13, are formed in the shield casing 11, and internal thread holes 15 for mounting a shield shell 32 are formed in the shield casing 11.

The wire harness 20 of this embodiment comprises a plurality of wires 21, connectors 22 fixedly secured respectively to end portions of the wires 21, and collective shielding means 30. The wire 21 is of the non-shielded type having an electrically-conductive core wire (conductor) 21*a* covered with an insulating sheath 21*b*, and the insulating sheath 21*b* is removed from the opposite end portions of the wire 21, so that the conductor 21*b* is exposed at these opposite end portions.

The connector 22 comprises a metal terminal 23, and a connector body 26 resin-molded to embrace the metal terminal 23. The separate connector bodies 26 are molded respectively on the plurality of metal terminals 23 at each end portion of the wire harness 20 comprising the plurality of wires 21.

A front end portion of the metal terminal 23 is formed into a flat plate-like terminal connection portion 24 which is elongate in a forward-rearward direction, and a bolt hole 24*a* is formed through this terminal connection portion 24. An open barrel-like wire connection portion 25 is formed at a rear end portion of the metal terminal 23, and the conductor 21*a* of the wire 21 is electrically connected to this wire connection portion 25 by pressing.

The connector body 26 is molded to embrace a rear end portion of the terminal connection portion 24 of the metal terminal 23, the whole of the wire connection portion 25 and the front end portion of the insulating sheath 21*b*. The terminal connection portion 24 of the metal terminal 23 projects from a front end surface of the connector body 26, and that portion of the wire 21, covered with the insulating sheath 21*b*, extends from a rear end surface of the connector body. An outer peripheral surface of the rear end portion of the connector body 26 has a circular shape, and a seal groove 27 is formed in this outer peripheral surface, and a seal ring 28 is mounted in this seal groove 27. A bracket 29, having a bolt hole 29*a*, is mounted on that portion of the outer peripheral surface of the rear end portion of the connector body 26 disposed rearwardly of the seal groove 27.

The collective shielding means 30 comprises a tubular shield member 31 for collectively covering the plurality of generally-parallel wires 21 in a surrounding manner, and the shield shell 32 for securing an end portion of the shield member 31 to the shield casing 11 of the equipment 10. The shield member 31 is a so-called braid, formed by weaving metal strands into a tubular shape, and can be deformed to be expanded and contracted in a direction of a length thereof. The shield shell 32 comprises an inner shell 33 of a generally elliptical or a generally oval shape having a relatively large width, and an outer shell 34 fitted on this inner shell 33, and bracket portions 35, each having a bolt hole 35*a*, are formed on and project from a peripheral edge portion of the inner shell 33. An end portion of the shield member 31 is held between an outer peripheral surface of the inner shell 33 and an inner peripheral surface of the outer shell 34, and the two shells 33 and 34, having the end portion of the shield member 31 held therebetween, are fixedly secured to each other by caulking. As a result, the shield shell 32 is fixedly secured to the end portion of the shield member 31 in electrically-connected relation thereto.

Next, the operation of this embodiment will be described.

For connecting the wire harness 20 to the equipment 10, the plurality of connectors 22 need to be inserted respectively into the mounting holes 13 in the equipment 10, and therefore the shield member 31 is beforehand deformed to be contracted such that the shield shell 32 is moved rearward away from the connectors 22 along the wires 21.

In this condition, the connectors 22 are inserted one by one into the mounting holes 13, respectively, and the terminal connection portion 24, projecting from the connector 22, is caused to overlap the corresponding equipment-side terminal 12. Then, the bracket 29, mounted on the connector body 26, is abutted against an outer surface of the shield casing 11, and a bolt 36, passing through the bolt hole 29*a* in the bracket 29, is threaded into the internal thread hole 14 in the shield casing 11, and is tightened, thereby fixing the connector 22 to the shield casing 11. Within the shield casing 11, a nut 38 is threaded on a bolt 37, passing through the bolt holes 24*a* and 12*a* formed respectively in the terminal connection portion 24 and the equipment-side terminal 12, and is tightened, thereby electrically connecting the metal terminal 23 and the equipment-side terminal 12 together in a manner to prevent a relative movement therebetween. In this condition, the seal ring 28, mounted on the outer peripheral surface of the connector body 26, is held in intimate contact with the inner peripheral surface of the mounting hole 13, thereby sealing a gap between the connector body 26 and the inner surface of the mounting hole 13. Thus, the mounting of one connector 22 is completed.

Thereafter, the other connectors 22 will be mounted in the same manner, and each of those connectors 22, which are to be mounted after the first-mounted connector 22, is once moved back to a position away from the already-mounted connector(s) 22, and then is fitted into the mounting hole 13. At this time, the thus moved-back connector 22 will not abut against the shield shell 32 since the shield shell 32 has already been moved to the rear position as described above, and therefore the mounting operation of those connectors 22, which are to be mounted after the first-mounted connector 22, will not be affected.

After the mounting of all of the connectors 22 is completed, the shield shell 32, which has been moved to the rear position, is moved forward, so that the bracket portions 35 on the inner shell 33 are brought into abutting engagement with the outer surface of the shield casing 11. The bracket portions 35 are abutted respectively against such portions of the shield casing that these bracket portions 35 will not overlap the brackets 29 of the connectors 22. A bolt 39, passing through the bolt hole 35*a* in each bracket portion 35, is threaded into the internal thread hole 15 in the shield casing 11, and is tightened. As a result, the shield shell 32 is fixed to the shield casing 11 in electrically-connected relation thereto. Thus, the connection of the wire harness 20 to the equipment 10 is completed.

Figure 3:
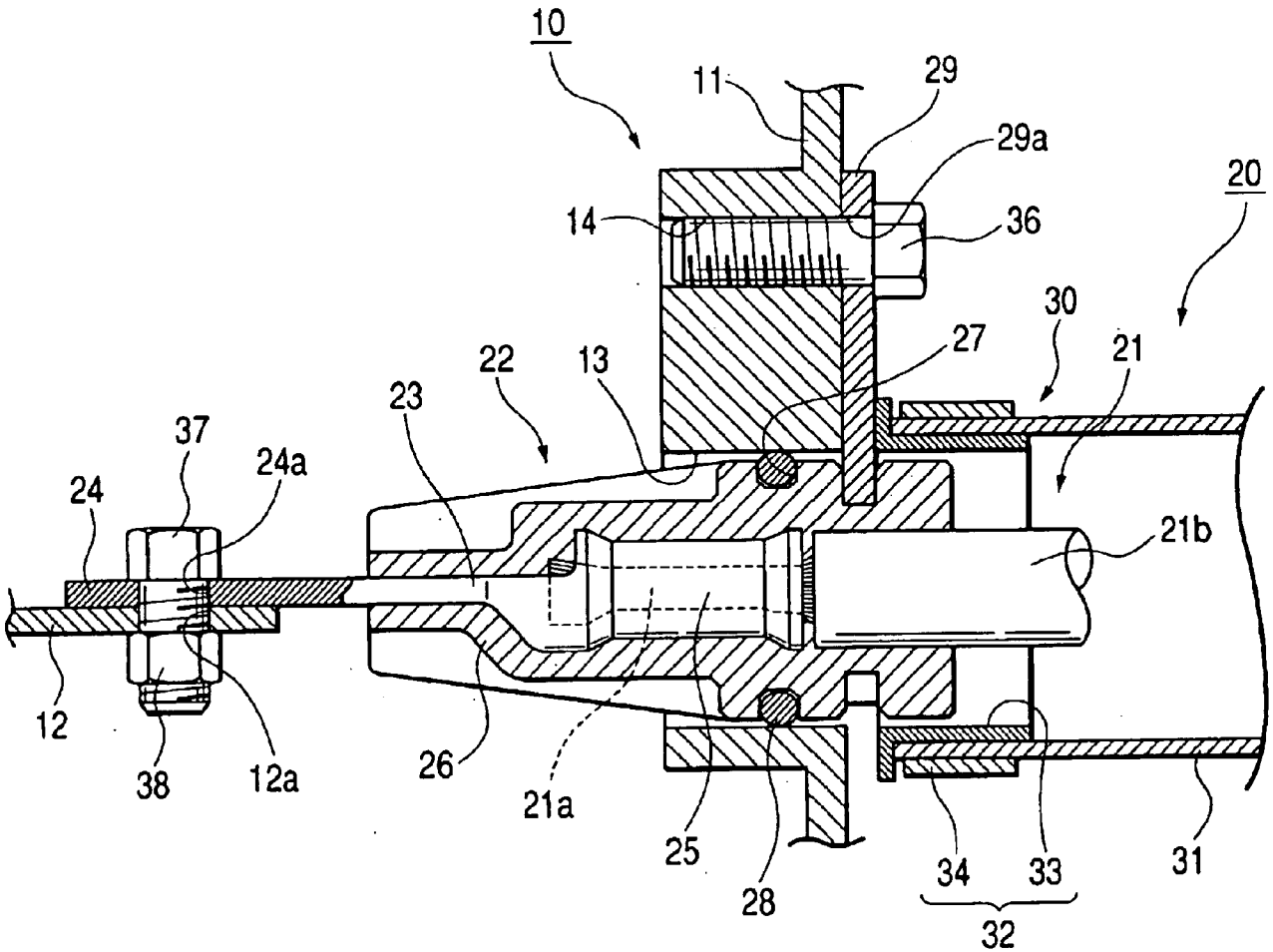
FIG. 3 is a cross-sectional view showing a condition in which a shield shell is mounted on the equipment.
Figure 4:
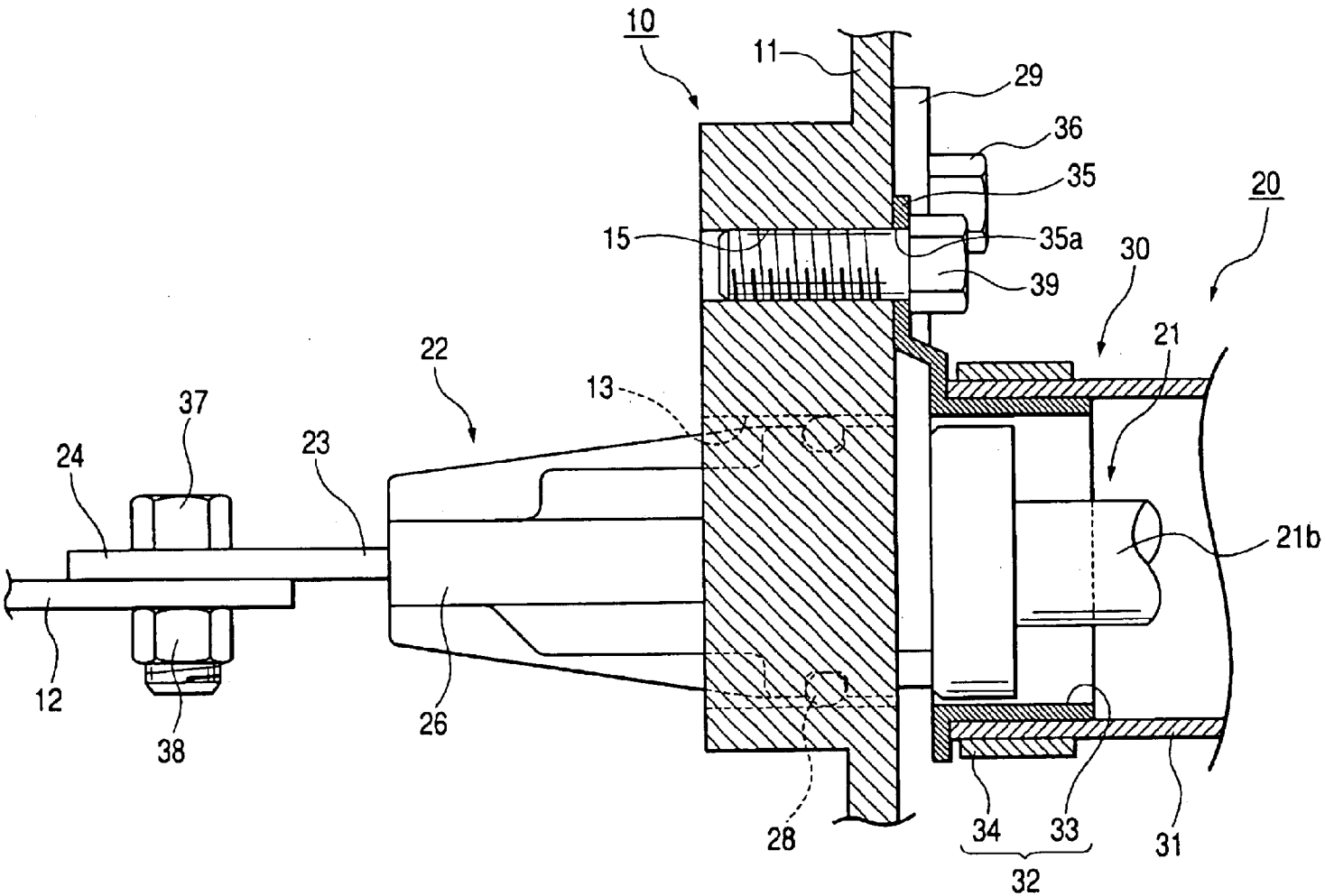
FIG. 4 is a cross-sectional view showing a condition in which the shield shell is mounted on the equipment.

The brackets 29 of the connectors 22 project outwardly beyond the shield shell 32, and therefore the front end of the shield shell 32 is spaced from the shield casing 11 by a distance corresponding to the thickness of the bracket 29 as shown in FIG. 3. However, each bracket 29 is in the form of a thin sheet, and therefore the sealing function will not be much lowered by the gap between the shield casing 11 and the shield shell 32. Each bracket portion 35 has such a shape that it slightly projects forwardly, and therefore the bracket portion 35 can be fixed to the shield casing 11.

As described above, in this embodiment, there is provided the single shield member 31 for collectively shielding the plurality of wires 21, and this shield member 31 is mounted on the shield casing 11 through the shield shell 32. Therefore, although the plurality of wires 21 are used, only one shield shell 32 is needed, and the number of the component parts is smaller as compared with the structure in which one shield shell is provided for each wire.

And besides, the connector body 26 is molded to embrace the wire connection portion 25, and therefore the end portion of the wire 21 is embedded in the connector body 26, and therefore metal wire elements, forming the conductor 21*a* of the wire 21, will not be exposed. Therefore, a liquid within the shield casing 11 will not leak to the exterior through gaps between the metal wire elements forming the conductor 21*a*.

In the case where one connector body is molded to collectively embrace a plurality of metal terminals, there are occasions when there are variations in the positional relation between terminal connection portions of the metal terminals. In such a case, there is a fear that the terminal connection portions can not be properly connected to the equipment-side terminals. In this embodiment, however, one connector body 26 is molded for each metal terminal 23, and therefore the connector bodies 26 (and hence the metal terminals 26) can be mounted on the equipment 10 independently of one another, and therefore the metal terminals 23 can be positively connected to the equipment-side terminals 12, respectively.

[Second Embodiment]

Figure 5:
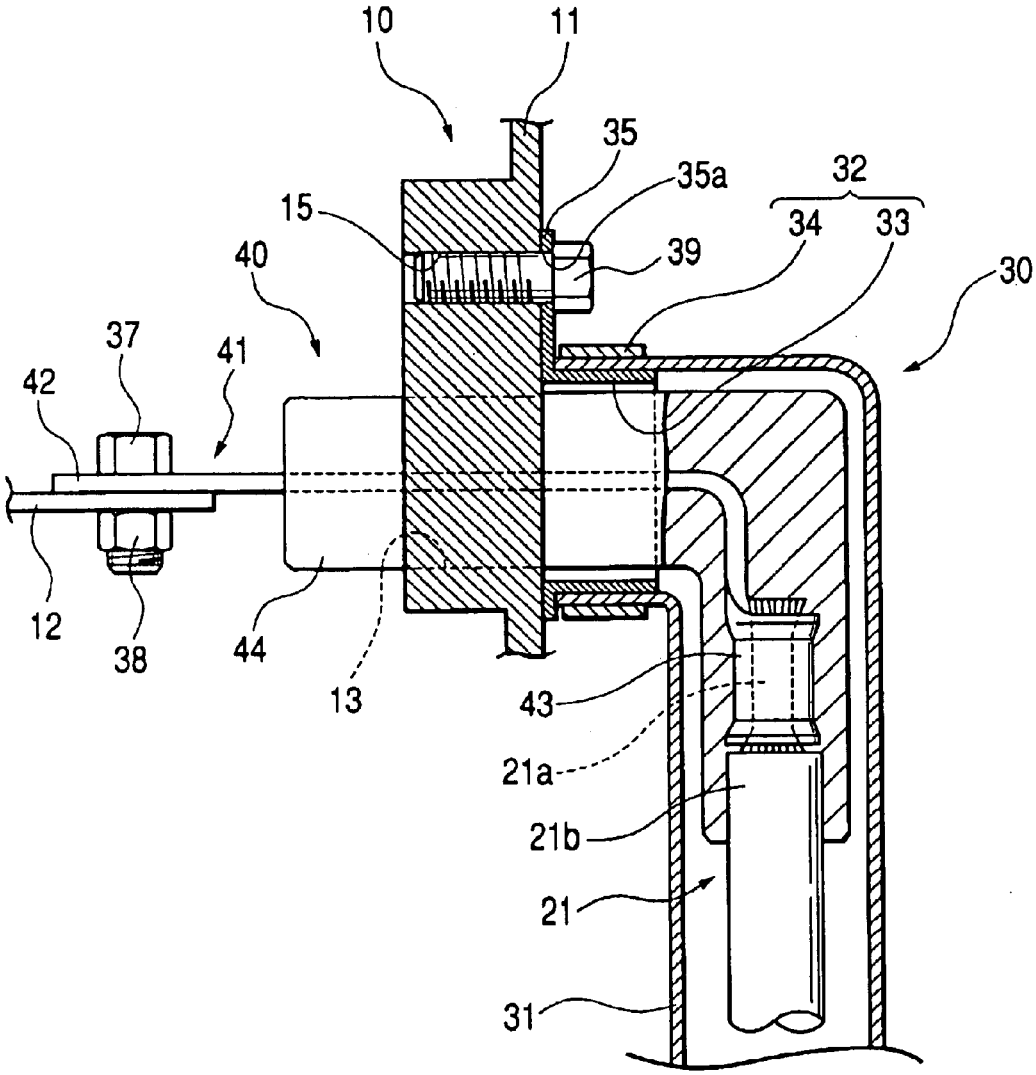
FIG. 5 is a cross-sectional view of a second embodiment.

Next, a second embodiment of the present invention will be described with reference to FIG. 5.

This second embodiment differs from the first embodiment in that a connector 40 has an L-shape. The other construction is the same as that of the first embodiment, and therefore identical portions will be designated by identical reference numerals, respectively, and explanation of the structure, operation and effects thereof will be omitted.

In this embodiment, the connector 40 comprises an L-shaped metal terminal 41, and a connector body 44 resin-molded to embrace the metal terminal 41. The separate connector bodies 44 are molded to respectively embrace the metal terminals 41 fixedly secured respectively to wires 21.

A horizontal front end portion of the metal terminal 41 is formed into a terminal connection portion 42, and an open barrel-like wire connection portion 43 is formed at a rear end portion of the metal terminal 41 which extends downwardly (in a direction perpendicular to the terminal connection portion 42), and a conductor 21*a* of the wire 21 is electrically connected to this wire connection portion 43 by pressing.

The connector body 44 has an L-shape, and is molded to embrace a rear end portion of the terminal connection portion 42 of the metal terminal 41, the whole of the wire connection portion 43 and a front end portion of an insulating sheath 21*b*. The terminal connection portion 42 of the metal terminal 41 projects from a front end surface of the connector body 44, and that portion of the wire 21, covered with the insulating sheath 21*b*, extends downwardly from a rear end surface of the connector body. The connector body 44 is fixedly secured to a shield casing 11 through a bracket (not shown), and a gap between an inner peripheral surface of a mounting hole 13 and the connector body 44 is sealed by a seal ring (not shown).

[Other Embodiments]

The present invention is not limited to the embodiments described above and illustrated in the drawings, and for example the following embodiments fall within the scope of the invention, and further various modifications other than the following embodiments can be made without departing from the scope of the invention.

(1) In the above embodiments, although each of the connector bodies is molded to embrace a respective one of the plurality of metal terminals, a connector body of the present invention may be molded to collectively embrace a plurality of metal terminals (2) In the first embodiment, both of the connector bodies, provided respectively at the opposite ends of each wire, have an I-shape. However, in the present invention, there may be provided a construction in which the connector body, provided at one end of the wire, has an I-shape while the connector body, provided at the other end of the wire, has an L-shape as in the second embodiment.

(3) In the second embodiment, both of the connector bodies, provided respectively at the opposite ends of each wire, have an L-shape. However, in the present invention, there may be provided a construction in which the connector body, provided at one end of the wire, has an L-shape while the connector body, provided at the other end of the wire, has an I-shape as in the first embodiment.

What is claimed is:

1. An equipment-mounting wire harness for mounting on an equipment, wherein the equipment comprises a shield casing for accommodating a plurality of equipment-side terminals therein, the shield casing including a mounting hole which corresponds to the equipment-side terminals, the equipment-mounting wire harness comprising:

a plurality of wires;

a plurality of metal terminals each including a terminal connection portion for connecting to the corresponding equipment-side terminal, and a wire connection portion for connecting to an end portion of the corresponding wire;

a connector capable of being fitted into the mounting hole, the connector including a connector body molded inside the connector, and providing the wire connection portion;

a seal ring for sealing a gap between the connector body and an inner surface of the mounting hole;

a tubular shield member for collectively covering the plurality of wires in a surrounding manner;

a shield shell for securing an end portion of the shield member to the shield casing;

wherein the equipment-mounting wire harness provides a plurality of connectors on opposite ends of the equipment-mounting wire harness.

2. The equipment-mounting wire harness according to claim 1, wherein the connector body includes a plurality of the connector bodies, each separately molded to embrace the plurality of the metal terminals respectively; and the shield shell is capable of being moved along the wires while deforming the shield member.

3. The equipment-mounting wire harness according to claim 1, wherein the tubular shield member is braided into a tubular shape.

* * * * *